US007063023B2

(12) United States Patent
Takai et al.

(10) Patent No.: US 7,063,023 B2
(45) Date of Patent: Jun. 20, 2006

(54) RAILWAY CAR AND BOGIE FOR RAILWAY CAR

(75) Inventors: Hideo Takai, Hikari (JP); Motomi Hiraishi, Kudamatsu (JP); Minoru Nakamura, Kudamatsu (JP); Katsuyuki Iwasaki, Kudamatsu (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/642,163

(22) Filed: Aug. 18, 2003

(65) Prior Publication Data

US 2004/0187729 A1 Sep. 30, 2004

(30) Foreign Application Priority Data

Mar. 28, 2003 (JP) ..... 2003-092123

(51) Int. Cl.
*B61D 17/00* (2006.01)

(52) U.S. Cl. ..... 105/396; 105/414

(58) Field of Classification Search ..... 105/157.1, 105/182.1, 238.1, 396, 413, 414
See application file for complete search history.

(56) References Cited

U.S. PATENT DOCUMENTS 1,691,723 A 11/1928 Keys
3,911,830 A * 10/1975 Adams ..... 105/164
4,658,734 A 4/1987 Mroz
5,673,627 A * 10/1997 Bieber et al. ..... 105/329.1
6,651,567 B1 * 11/2003 Takeichi et al. ..... 105/329.1

FOREIGN PATENT DOCUMENTS

DE 198 24 125 9/1999
GB 708066 4/1954

* cited by examiner

*Primary Examiner*—S. Joseph Morano
*Assistant Examiner*—Robert J. McCarry, Jr.
(74) *Attorney, Agent, or Firm*—Antonelli, Terry, Stout and Kraus, LLP.

(57) ABSTRACT

A subframe 50 is connected via a vibration isolator 40 to a floor 11 of a railway car body 10, and the subframe 50 has a center pin 60 protruding downward therefrom and connected to a bogie 30. The subframe 50 is connected to a coupling device 70, and is disposed so as to come into contact with stoppers 13 on side beams 12 of the car body 10. According to this structure, since the coupling device 70 is not directly connected to the car body, there is no need to weld a rigid member to the bottom surface of the floor 11, and the railway car body can be manufactured easily. Moreover, since the subframe 50 is connected to the floor 11 via a vibration isolator, less noise is transmitted to the car body. Power is transmitted from the coupling device 70 or bogie 30 to side beams, so the structure of the car body can be simplified.

20 Claims, 7 Drawing Sheets

12: SIDE BEAM, 13: STOPPER, 33: WHEELS 50: SUBFRAME, 55: GUIDE, 60: CENTER PIN, 70: COUPLING ROD, 90: AIR SPRING

10: CAR BODY
11: FLOOR
30: BOGIE
33: WHEELS
40: VIBRATION ISOLATOR
50: SUBFRAME

12: SIDE BEAM, 13: STOPPER, 33: WHEELS 50: SUBFRAME, 55: GUIDE, 60: CENTER PIN, 70: COUPLING ROD, 90: AIR SPRING

10: CAR BODY

11: FLOOR

30: BOGIE

33: WHEELS

40: VIBRATION ISOLATOR

50: SUBFRAME

RAILWAY CAR AND BOGIE FOR RAILWAY CAR

FIELD OF THE INVENTION

The present invention relates to a passenger railway car.

DESCRIPTION OF THE RELATED ART

Patent reference document 1, Japanese Patent Laid-Open No. 04-173472, discloses a passenger railway car (rolling stock) having a car body mounted on a bogie, the car body and the bogie being connected via a so-called center pin or connecting link disposed to the bogie. Furthermore, the car body is mounted via an air spring on the bogie. One car body is connected to an adjacent car body via a coupling device. Power is transmitted from the preceding front car body via a coupling device to the following car body, and via another coupling device to the subsequent car body. The coupling device comprises a coupler, a coupling rod, and an elastic member disposed at the center of the coupling device in the traveling direction so as to absorb the shock in that direction. Moreover, this portion is disposed so as to be able to slide with respect to the car body in a vertical movement.

The drawbacks of the conventional passenger railway car are noise and uncomfortable ride quality. One cause of the noise is the vibration generated at the bogie which is transmitted to the car body through the center pin.

Further, the elastic member of the coupling device capable of sliding with respect to the car body may cause the coupling device to collide against the car body by the vertical and horizontal movements of the car body due to the irregularity of the rail track, which is another cause of noise and vibration.

According to the conventional railway car, the center pin and the coupler are fixed to the car body 10, so the ends of the car body must have sufficient rigidity. In order to obtain sufficient rigidity, a plate having considerable thickness is welded onto the floor board. However, welding operation is not easy since strain is often generated by the process.

SUMMARY OF THE INVENTION

The object of the present invention is to provide an inexpensive car body with low noise.

The object of the present invention can be achieved by providing a subframe comprising a center pin between the bogie and the car body with a clearance.

DETAILED DESCRIPTION OF THE PREFERRED EMBODIMENTS

Figure 1:
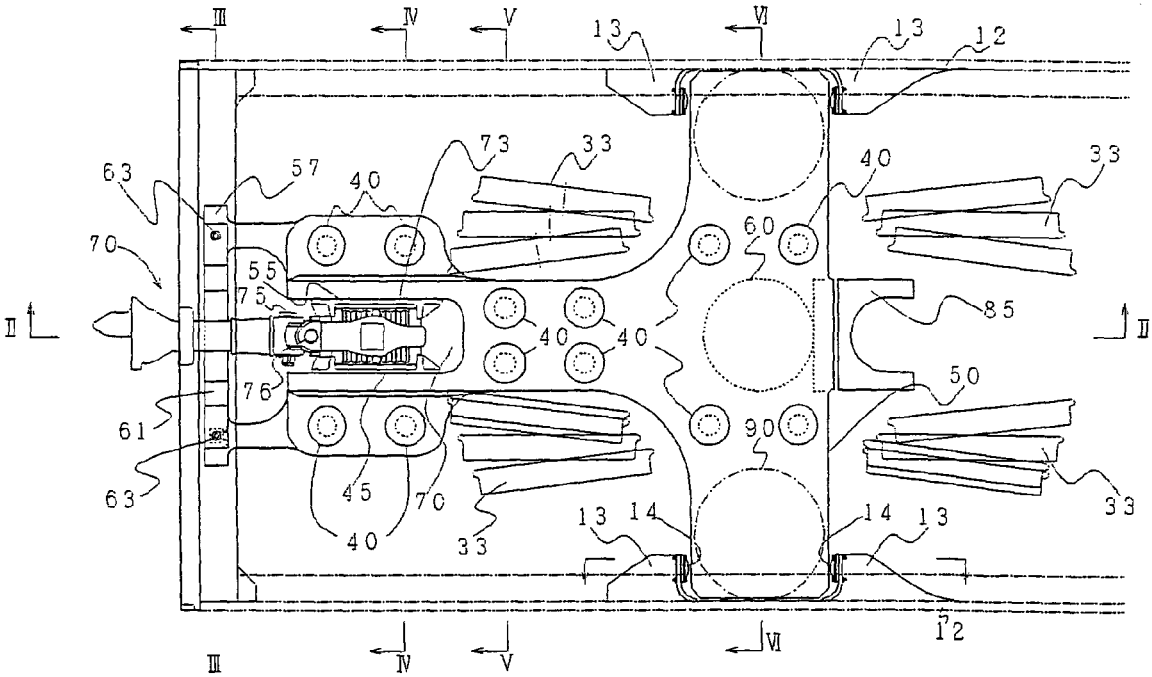
FIG. 1 is a plan view showing a preferred embodiment of the present invention.
Figure 2:
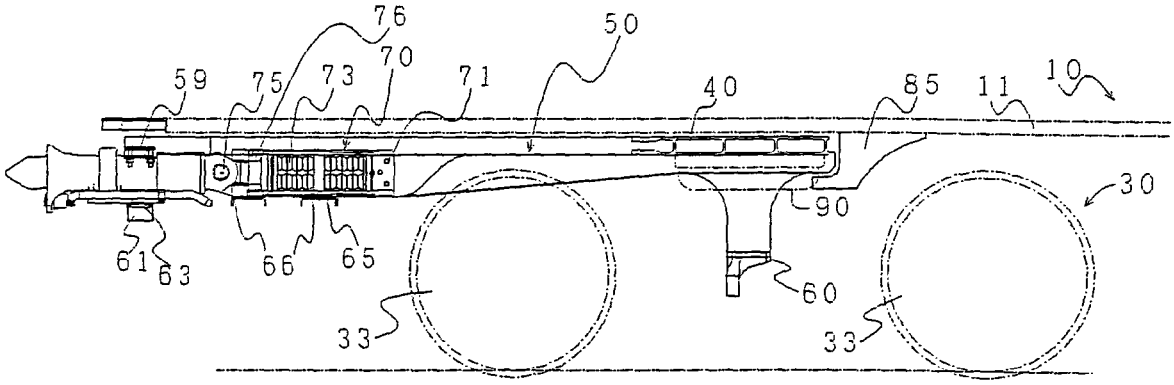
FIG. 2 is a cross-sectional view taken at line II—II of FIG. 1.
Figure 3:
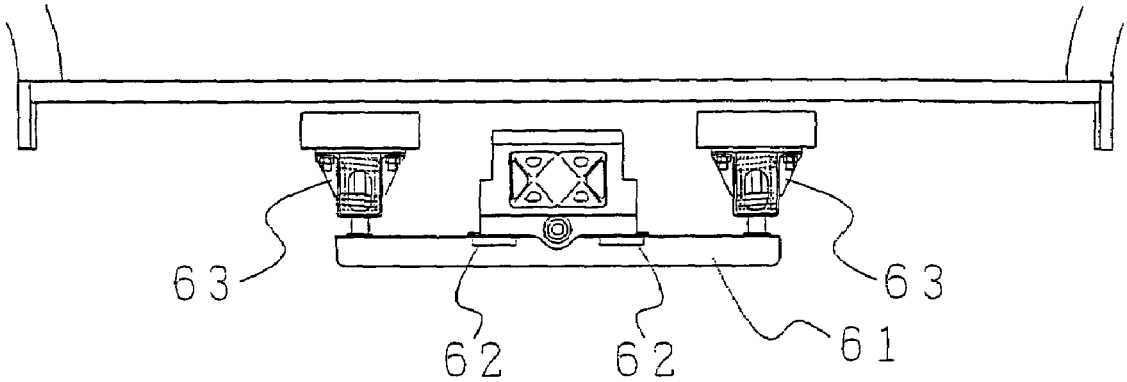
FIG. 3 is a cross-sectional view taken at line III—III of FIG. 1.
Figure 4:
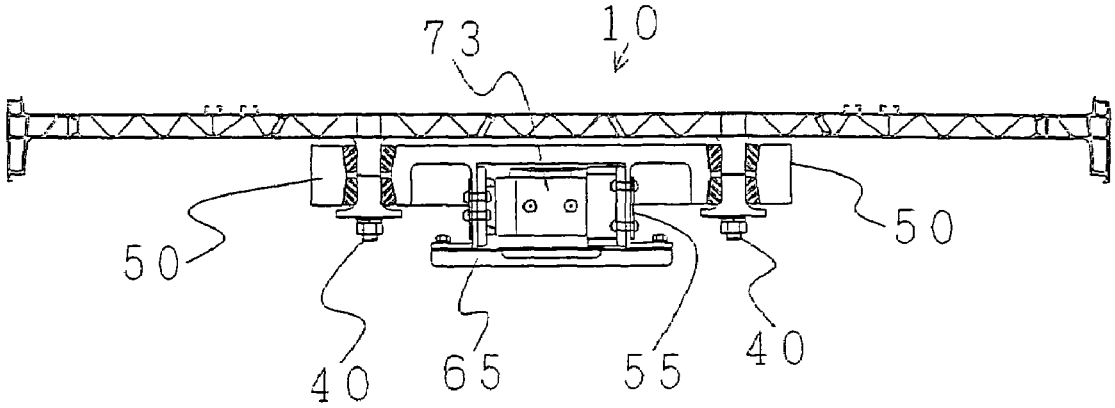
FIG. 4 is a cross-sectional view taken at line IV—IV of FIG. 1.
Figure 5:
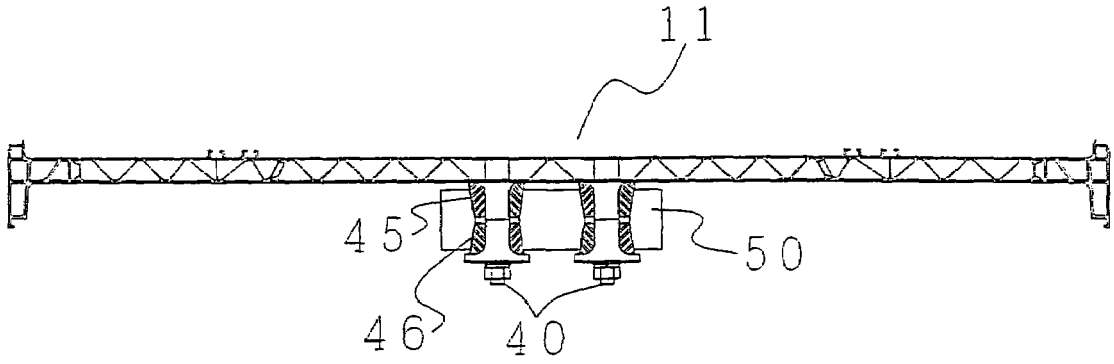
FIG. 5 is a cross-sectional view taken at line V—V of FIG. 1.
Figure 6:
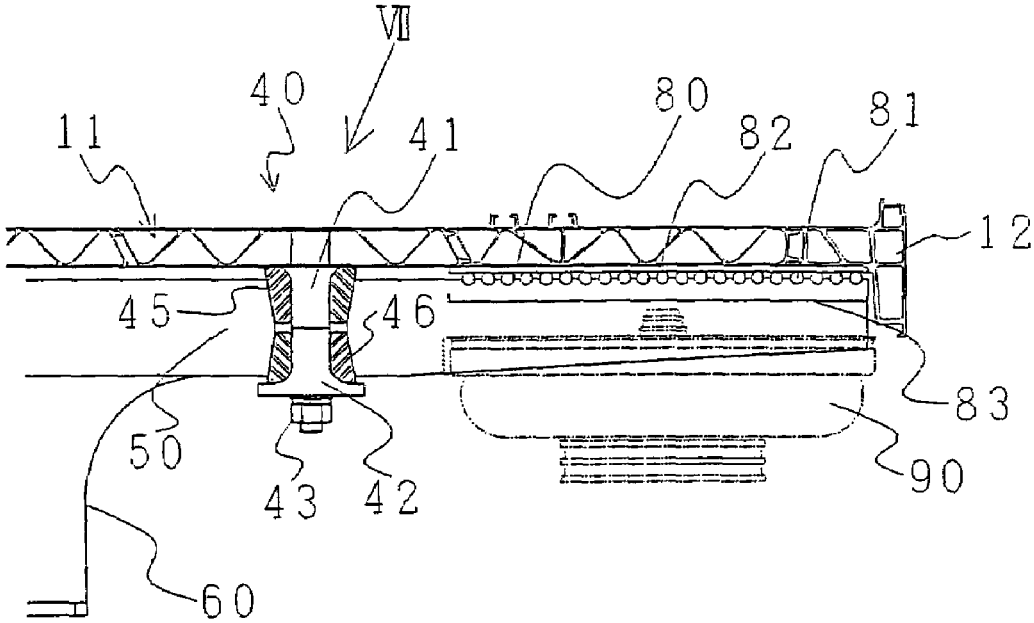
FIG. 6 is a cross-sectional view taken at line VI—VI of FIG. 1.
Figure 7:
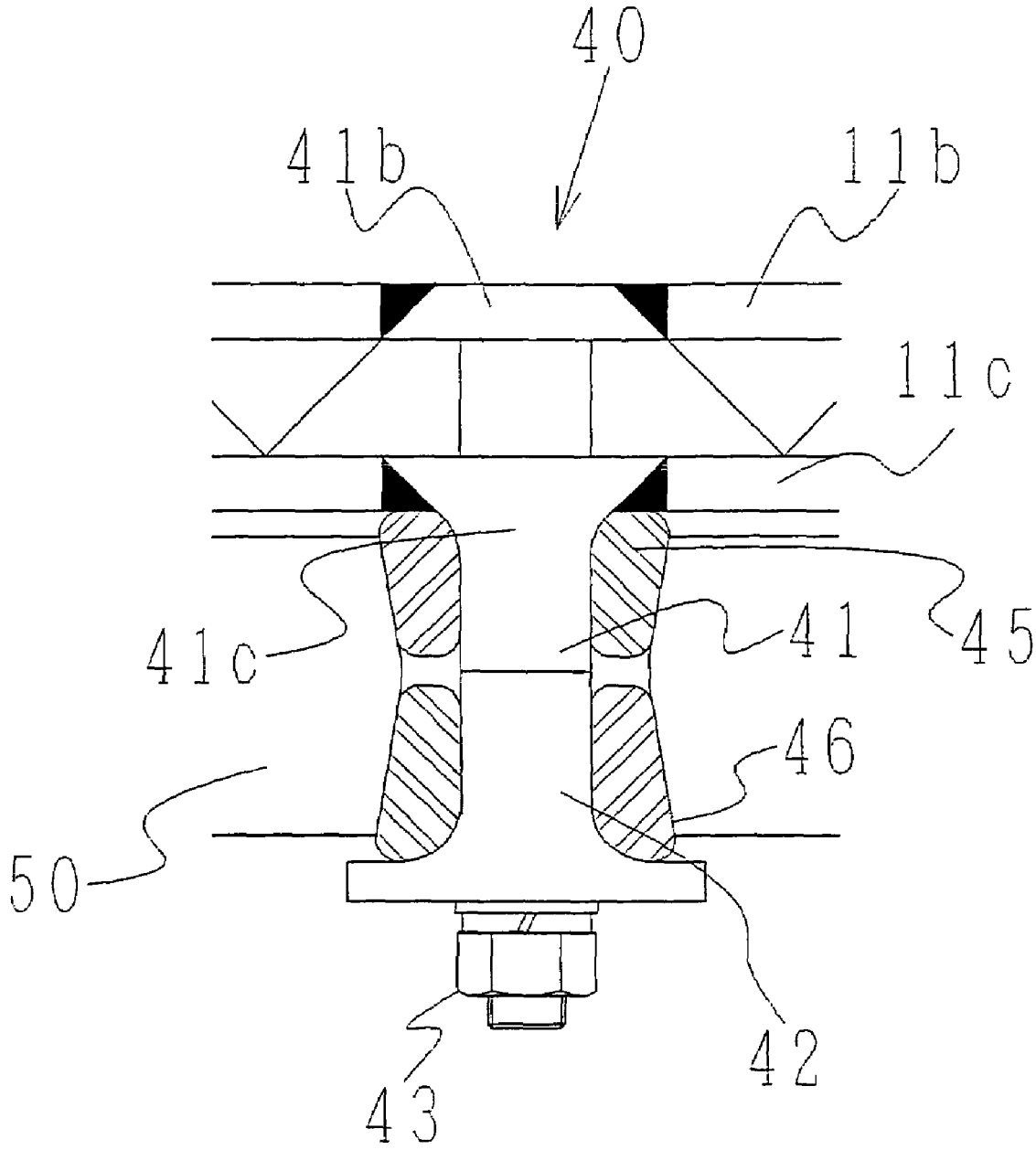
FIG. 7 is a vertical cross-sectional view showing the area pointed by arrow VII of FIG. 6.

One preferred embodiment of the present invention will now be explained with reference to FIGS. 1 through 7. FIG. 1 is a plan view showing the car body 10 with the floor 11 omitted. FIG. 6 illustrates the right half of the body.

A car body 10 is mounted on a bogie 30 via a subframe 50 at the longitudinal end of the car body. In other words, a subframe 50 is disposed between the car body 10 and the bogie 30. The subframe 50 is fixed to the floor 11 of the car body 10 through plural vibration isolators 40, 40. The floor 11 of the car body 10 is formed by arranging long extruded hollow shape members made of aluminum alloy side by side in the width direction of the car body 10, the length of the members extending in the longitudinal direction of the car body 10, and welding the members together through welding or friction stir welding. The subframe 50 is also made of aluminum alloy.

The vibration isolator 40 is composed of a screw rod 41 passing downward through the hollow shape member constituting the floor 11 from above, a support seat 42 inserted to the screw rod from underneath, a nut 43, and rubbers 45 and 46. The rubbers 45 and 46 are in contact with the subframe 50. The subframe 50 is formed of a rigid, hollow thick board. The hollow interior of the subframe functions as an air reservoir for an air spring 90.

The screw rod 41 passes through the floor 11 from above, and is welded to the floor both from above and underneath the floor. The support seat 42 is disposed so as to pass through the subframe 50. An upper circular flange 41*b* disposed on the top portion of the screw rod 41 is welded onto an upper plate 11*b* constituting the hollow floor member from above, and a lower circular flange 41*c* is welded onto a lower plate 11*c* from underneath. The plates 11*b* and 11*c* are provided with round holes through which the circular flanges 41*b* and 41*c* are inserted. The circular flanges 41*b* and 41*c* are each provided with a beveling for welding. After welding the screw rod 41, the support seat 42 and the like are placed. Since the support seat 42 has a lower flange 42*b* with a diameter greater than the diameter of the through hole, when the floor 11 is raised in the upper direction, the flange 42*b* comes into contact with the subframe 50, thereby pulling the subframe 50 and the bogie 30 upward.

The subframe 50 has a firm structure formed by bonding relatively thick boards. The subframe 50 comprises a so-called center pin 60 that protrudes downward from the lower surface thereof, and is connected to the bogie 30 via a link 61.

An air spring 90 is disposed between the upper surface of the bogie 30 and the lower surface of the subframe 50. Actually, two air springs 90, 90 are disposed on both sides of the center pin 60. The air-spring 90 is formed and fixed to position in a well known manner.

Moreover, a known coupling rod (coupling device) 70 is connected to the subframe 50 in the horizontal direction. The longitudinal end of the coupling device 70 is connected to the subframe 50 via a pin 71. At the longitudinal center of the coupling device 70 is disposed an elastic draft gear 73, which is also allowed to move vertically along a guide 55 formed to the subframe 50. There is a relatively large clearance between the guide 55 and the draft gear 73. The structure of the draft gear 73 and the guide 55 are well known. The draft gear 73 can be formed of a coil spring or a flexible rubber spring. The relationship between the draft gear 73 and the guide 55 is well known.

The draft gear 73 is connected to the end of the coupling device 70 via a horizontal pin 75 and a vertical pin 76, the pins allowing the end of the coupling device 70 to pivot both in the horizontal and vertical directions. Such structure is also well known.

Further, the end of the coupling device 70 is supported by a receive seat 61 provided to the subframe 50 via a rubber seat 62. The rubber seat 62 absorbs the shock of the contact. A rubber seat 61 that comes into contact with the raised coupling device 70 is disposed on the subframe 50. The receive seat 61 is suspended through elastic members 63.

The center area of the coupling device 70 is supported via a receive seat 65 and a rubber seat 66.

The subframe 50 is substantially T-shaped when seen from above. The both side portions of the upper bar of the T (in other words, the areas where the air springs 90 are disposed) are located near the side beams 12 of the car body 10. Stoppers 13, 13 are disposed in front of and behind both side portions of the T with respect to the direction of travel of the car body, and the stoppers are capable of coming into contact with the side portions of the T. The stoppers 13 are fixed firmly to the side surfaces of the side beams. The surfaces of the stoppers 13 coming into contact with the subframe 50 are provided with rubber seats 14.

Thereby, the forward and backward power from the coupling device 70 is transmitted via the subframe 50 to the side beams 12 of the car body 10.

As mentioned earlier, known air springs 90, 90 are disposed between the lower surface of both side portions of the T and the upper side of the bogie. A slide apparatus 80 is disposed above the air spring 90 between the subframe 50 and the floor 11 of the car body 10. The slide apparatus 80 is composed of rubber rods having a round cross-section with a small diameter, an upper plate 82 and a lower plate 83 disposed above and below the rods. The upper plate 82 is flat, which is welded horizontally to the back surface of the floor board 11. The round rods 81 are disposed so that their axial direction corresponds to the proceeding direction of the car body. The lower plate 83 is provided with many grooves for retaining the plural round rods 81. The lower plate is welded onto the upper surface of the subframe 50.

According to this structure, when the bogie 30 pivots in the width direction of the car body at a branch and the like (when the car receives an impact in the width direction of the body), the round rods 81 are pressed, facilitating the pivoting movement of the bogie 30. In order to reduce the noise transmitted to the cabin, or in other words, in order to relieve the impact force loaded to the car body in the width direction, the axial direction of the round rods 81 are arranged in the longitudinal direction of the car body. Thus, when an impact force is received in the width direction of the car body, the rubber of the rods 81 shrink, reducing the force loaded to the car body. However, the rods 81 are long and stiff against the impact in the longitudinal direction of the car body.

In other words, the slide apparatus is for relieving the width-direction impact loaded to the car body. Thus, the slide apparatus 80 can be formed relatively thin. Instead of using round rods, the slide apparatus can use any form of deformable members as long as they deform in a different manner when receiving the impact in the width direction and the impact in the longitudinal direction. For example, ring-shaped cylinders of various diameters can be disposed concentrically, with rubber members having varying elasticity according to direction disposed between the cylinders. Along the circumference, there are areas where the rubber members exist and other areas where they do not. The modulus of elasticity of the rubber structure differ between the width direction of the car body and the longitudinal direction of the car body, due to the location or the elastic modulus of the rubber members disposed therein. The center axis of the rubber structure is fixed to the floor 11 and the subframe 50. Furthermore, a flexible plate may be used. The modulus of elasticity in the longitudinal direction of the car body is hardened by having a stopper protruding from the subframe come into contact with the car body.

It is desirable to provide a slide apparatus 80 to the car body even when the coupling device 70 is fixed to the car body 10.

The width (perpendicular to the longitudinal direction of the car body) of the subframe 50 of the area between the guide 55 and the upper bar of the T is narrowed. At the outer side of this narrowed width portion of the subframe is disposed a circular arc portion of a wheel 33 of the bogie 30 protruding in the upper direction. If a wheel is to be positioned at the outer side of the subframe, it is when the wheel 33 is elevated. The wheel 33 is usually located below the outer side of the narrowed width portion of the subframe. There is no subframe 50 disposed above the wheel 33.

Therefore, the distance from the rail (not shown) to the floor surface 11 of the car body 10 can be minimized. In other words, the height of the floor 11 from the rail can be made substantially equal to the floor height of a prior art car body having no subframe. In FIG. 1, the permissible range of movement of the plural wheels 33 are illustrated.

The coupling device 70 is connected to the subframe 50, and only indirectly connected to the car body 10 via the vibration isolator 40. Therefore, when the railway car passes a branch, the coupling device 70 may bump against the guide 55 generating noise, but less noise is transmitted to the cabin of the car body.

Moreover, less noise is transmitted from the bogie 30 through the center pin 60 to the cabin, since the subframe 50 is connected to the car body via the vibration isolator 40. Through it is necessary to create the subframe 50 as a rigid body, since the subframe 50 and the floor of the car body 10 are separate members and the subframe 50 is not welded onto the car body 10, the floor 11 of the car body 10 can be manufactured relatively simply. The transmission of noise is further reduced by having the subframe 50 come into contact with the floor 11 via rubber rods 81 at the slide apparatus portion 80.

A stopper 85 is disposed at the rear end of the subframe 50 in the center of width thereof. The stopper 85 is welded to the floor 11, and supports the load of the coupling device 70 via the subframe 50. The stopper 85 has an L-shaped body that is in contact with the subframe 50 and supports the downward load thereof. The stopper 85 is disposed in case the vibration isolator 40, 40 may break. The portion of the floor on which the stopper 85 is disposed is built rigidly.

If the stopper 85 can support the load by itself, the stoppers 13, 13 mentioned earlier are not necessary, and vice versa, if the stoppers 13, 13 can support the entire load, there is no need to provide the stopper 85.

Since the subframe 50 comes into contact with the side beams 12, the power from the coupling device 70 and the bogie 30 can be transmitted directly to the rigid side beams 12, making it possible to simplify the structure of the floor 11 of the car body 10.

The location of the slide apparatus 80 is not limited to where the air spring 90 is disposed, but can be set anywhere between the subframe 50 and the floor 11 where the vibration isolators 40 are disposed.

Moreover, by mounting apparatuses that generate vibration (such as air compressors, air conditioners and transformers) on the subframe 50 (for example, by suspending them from the subframe), the vibration being transmitted into the cabin can be reduced effectively.

The space inside the subframe 50 can be utilized as a sand reservoir for sanding, or water tank for drinking or for lavatory use.

Furthermore, the space inside the subframe 50 can be utilized as space for mounting damping materials or for filling spherical members in order to prevent noise.

Since the size of the subframe 50 is small, it can be manufactured easily using high-strength material that is different from the material used for forming the floor of the car body. The transmission of vibration from the subframe is reduced effectively.

What is claimed is:

1. A railway car comprising:

a subframe disposed under a floor of a car body with a clearance between said subframe and said floor, said subframe capable of moving together in synchronism with said car body in a traveling direction of said car body, said car body having side beams respectively at two sides thereof, in said traveling direction; and a center pin protruding downward from said subframe and connected to a bogie, wherein said subframe is disposed so that both front and rear sides with respect to the traveling direction at both side portions of the subframe in the width-direction of the car body are capable of coming into contact with stoppers disposed on both side beams of said car body at front and rear sides with respect to the traveling direction.

2. A railway car according to claim 1, wherein the floor of said car body and said subframe are connected via an engagement apparatus including a vibration isolator or a metallic spring.

3. A railway car according to claim 2, wherein said engagement apparatus has sufficient strength so that said subframe will not fall off from said car body when the railway car collides with an object or is derailed, or when the car body is craned.

4. A railway car according to claim 1, wherein said subframe is connected to a coupling device comprising a coupler for connecting the car body with an adjacent car body and a draft gear.

5. A railway car according to claim 4, wherein said subframe supports a front end portion of said coupling device via an elastic member including rubber and/or metallic spring.

6. A railway car according to claim 1, wherein the bottom of the subframe is not located above the top of wheels disposed to said bogie.

7. A railway car according to claim 1, wherein said stoppers are attached to inner side surfaces of said side beams, and are capable of coming into contact with the front end and the rear end of said subframe with respect to the traveling direction of said railway car.

8. A railway car according to claim 1, wherein a compressor is disposed on said subframe.

9. A railway car according to claim 1, wherein said subframe is hollow, the inside space containing air for an air-spring, sand, water, damping material, or spherical members.

10. A railway car according to claim 1, wherein said subframe is removably attached to said car body.

11. A railway car according to claim 1, further comprising:

a slide apparatus facilitating movement of said subframe in the width direction of said car body, disposed above air springs located at both width direction sides of said subframe and between said floor and an upper surface of said subframe.

12. A railway car according to claim 11, wherein said slide apparatus comprises a plurality of rubber round rods, a plate disposed above and coming into contact with said rods and fixed to said floor, and a receive seat disposed below and coming into contact with said rods and fixed to said subframe, said receive seat having plural grooves that support said plural rods, the axial direction of said rods and said grooves corresponding to the longitudinal direction of the car body.

13. A bogie-subframe combination for a railway car comprising:

a subframe, disposed under a floor of a car body having side beams at respective sides of the car body in a traveling direction of said car body, with a clearance between said subframe and said floor, said subframe capable of moving together in synchronism with said car body in the traveling direction of said car body;

a bogie under said subframe; and a center pin protruding downward from said subframe and connected to said bogie, wherein said subframe is connected to a coupling device comprising a coupler for connecting the car body with an adjacent car body and a draft gear, and wherein said subframe is disposed so that both front and rear sides thereof with respect to the traveling direction are capable of coming into contact with stoppers disposed on both side beams of said car body.

14. A bogie-subframe combination for a railway car according to claim 13, wherein the floor of said car body and said subframe are connected via an engagement apparatus including a vibration isolator or a metallic spring.

15. A bogie-subframe combination for a railway car according to claim 14, wherein said engagement apparatus has sufficient strength so that said subframe will not fall off from said car body when the railway car collides with an object or is derailed, or when the car body is craned.

16. A bogie-subframe combination for a railway car according to claim 13, wherein said subframe supports a front end portion of said coupling device via an elastic member including rubber and/or metallic spring.

17. A bogie-subframe combination for a railway car according to claim 13, wherein the bottom of the subframe is not located above the top of wheels disposed to said bogie.

18. A bogie-subframe combination for a railway car according to claim 13, wherein said subframe is hollow, the inside space containing air for an air-spring, sand, water, damping material, or spherical members.

19. A railway car comprising:

a subframe disposed under a floor of a car body with a clearance between said subframe and said floor, said subframe capable of moving together in synchronism with said car body in a traveling direction of said car body;

a slide apparatus facilitating movement of said subframe in the width direction of said car body, disposed above air springs located at both width direction sides of said subframe and between said floor and an upper surface of said subframe, wherein said slide apparatus comprises a plurality of rubber round rods, a plate disposed above and coming into contact with said rods and fixed to said floor, and a receive seat disposed below and coming into contact with said rods and fixed to said subframe, said receive seat having plural grooves that support said plural rods, the axial direction of said rods and said grooves corresponding to the longitudinal direction of the car body; and a center pin protruding downward from said subframe and connected to a bogie, the subframe being located between the car body and the bogie and being on said bogie.

20. The railway car according to claim 19, wherein said subframe is connected to the car body via a vibration isolator.

* * * * *